US005467325A

United States Patent [19]

Juillerat

[11] Patent Number: 5,467,325

[45] Date of Patent: Nov. 14, 1995

[54] WATCH CASE

[75] Inventor: Jean-Charles Juillerat, Bienne, Switzerland

[73] Assignee: SMH Management Services AG, Biel, Switzerland

[21] Appl. No.: 335,338

[22] Filed: Nov. 3, 1994

[30] Foreign Application Priority Data

Dec. 23, 1993 [CH] Switzerland ..... 03859/93

[51] Int. Cl.[6] ..... G04B 37/00

[52] U.S. Cl. ..... 368/276; 368/289; 368/291; 368/309

[58] Field of Search ..... 368/88, 276, 286, 368/287, 289, 291, 309, 310

[56] References Cited

U.S. PATENT DOCUMENTS

| | | | |
|---|---|---|---|
| 3,643,424 | 2/1972 | Simon . | |
| 4,104,867 | 8/1978 | Worsham . | |
| 4,217,752 | 8/1980 | Matsumura | 368/289 |
| 4,545,688 | 10/1985 | Ray et al. | 368/291 |
| 4,845,694 | 7/1989 | Vuilleumier | 368/309 |

FOREIGN PATENT DOCUMENTS

| | | |
|---|---|---|
| 1359524 | 3/1964 | France . |
| 530350 | 1/1955 | Italy . |
| 338405 | 5/1959 | Switzerland . |
| 79531/59 | 10/1959 | Switzerland . |

*Primary Examiner*—Vit W. Miska
*Attorney, Agent, or Firm*—Pollock, Vande Sande & Priddy

[57] ABSTRACT

A watch case (M) including a caseband (1) and a back cover (4) which can be engaged with and clamped in the caseband by imparting a rotational movement to the back cover (4) through a predetermined angle (Ω) around an axis of closure (0—0'). The back cover (4) and the caseband (1) include wall portions (16, 24) of complementary undercut forms the peripheral profile of which comprises four sections (38, 48) in circular arc form each centered on a center ($C_c$, $C_f$) separated from the axis of closure (0—0'). The sections (38, 48) are connected among themselves by a reentrant section (40, 52). Each back cover section (48) is associated with a caseband (1) section (38). In one position, each section (48) of the back cover (4) is off-centered relative to the section (38) of the caseband (1) associated therewith and in another position, each circular arc-form section (48) of the back cover (4) is concentric with the associated section (38) of the caseband (1) and the lateral wall (16) of each section (48) of the back cover (4) is in close contact with the lateral wall (24) of the associated section (38) of the caseband (1).

7 Claims, 5 Drawing Sheets

WATCH CASE

FIELD OF THE INVENTION

The present invention generally concerns watch cases and, more specifically, a sealed watch case including, in particular, a caseband and a back cover which can be engaged with and clamped therein by imparting a rotational movement to the back cover through a predetermined angle around a geometric axis which will be referred to as the closure axis in the rest of the description.

BACKGROUND OF THE INVENTION

A watch case responding to this definition has already been described in the patent document CH-338405. In this latter, the watch case includes a caseband, a back cover and a packing inter-posed between the back cover and the caseband. The back cover includes a peripheral flange having an inclined exterior wall in the form of an ellipse or polygon and the caseband includes an annular groove having an inclined wall of a form corresponding to that of the wall of the flange on the back cover. The back cover flange can thus be engaged in the groove of the caseband and be clamped therein by rotating the back cover on the caseband.

This case, however, exhibits the drawback of being subject to rapid wear. Effectively, the elliptic or polygonal form of the peripheral flange and the complementary form of the caseband groove permit clamping of the back cover on the caseband only along the lines of contact which extend in a direction parallel to that of the inclined wall of the flange or of the groove. This has as result that a sealed closing of the case is no longer effectively assured, indeed not at all assured following a certain number of opening and closing operations.

To that is added the fact that the behaviour in compression of the packing is equivalent to that of a seal in a watch case in which the back cover is secured to the caseband by screws and in which the seal is strongly compressed in the region of the screws and very slightly between such regions which leads to sealing problems. Effectively, during tightening of the back cover on the caseband, only the portions of the back cover in contact with the caseband tend to penetrate into the caseband and locally compress the seal in such regions, because of the intrinsic flexibility of the back cover.

The invention thus has as main purpose to overcome the drawbacks of the above-mentioned prior art in providing a sealed watch case comprising a system for securing the back cover onto the caseband having satisfactory and long-lasting effectiveness and which is simple and of easy manufacture.

SUMMARY OF THE INVENTION

To this effect, the object of the invention is a sealed watch case including two elements respectively forming a caseband and a back cover, a packing being interposed between these two elements, a first of the elements including an axially bounded and undercut lateral peripheral wall portion, the second element likewise exhibiting an axially bounded and undercut lateral peripheral wall portion having a form complementary to the lateral wall portion of said first element, the lateral wall portions of said first and second elements being so conformed that in a first angular position relative to a rotation axis, referred to as the closure axis, the first element may be separated from the second element and that, in a second angular position in which the first element is turned through a predetermined angle around said closure axis starting from the first position, the first element is clamped in the second element whilst compressing the packing.

In conformity with the invention, the watch case is characterized in that the peripheral profile of the lateral wall portion of the first element comprises at least two sections in circular arc form each centered on a point shifted relative to the closure axis, such two sections being connected to one another by a reentrant section in order to form projections, in that the peripheral profile of the lateral wall portion of the second element comprises at least two sections in circular arc form each centered on a point shifted relative to the closure axis, such two sections being connected to one another by a broken profile portion defining an opening of such depth as to permit, in the first angular position, passage of the projections of the first element into the openings of the second element, in that each circular arc-formed section of the first element is associated with a circular arc-formed section of the second element, in that the sections associated with one another have substantially the same radius, in that in the first angular position, each circular arc-formed section of the first element is off-centered relative to the circular arc-formed section of the second element associated therewith, and in that in the second angular position each circular arc-formed section of the first element is concentric with the circular arc-formed section of the second element associated therewith so that the lateral wall of each circular arc-formed section of the second element is in close contact over its entire extent with the lateral wall of the circular arc-formed section of the first element associated therewith.

Thanks to these characteristics, contact of the outer wall of the back cover flange is obtained over a substantial surface which distributes the friction between the two elements and thus diminishes the wear of the system and increases its reliability. The structure of the case according to the invention furthermore permits the obtaining of a progressive tightening of the first elements onto the second element, while compressing the packing in a uniform and progressive manner.

According to a preferred embodiment of the invention, the peripheral profile of the lateral portion of the wall of the first and of the second elements comprises, for each of them, four sections of circular arc form regularly distributed around the first and second elements.

Thus, the back cover is automatically centered on the caseband in a manner such that its position on the caseband prior to clamping of the back cover is facilitated.

According to a preferred characteristic of the invention, the first element is the caseband and the second element is the back cover.

According to another preferred characteristic of the invention, the lateral wall portion of the back cover is external and the lateral wall portion of the caseband is internal.

Other advantages and characteristics of the present invention will appear more clearly upon reading the following description of a specific example of an embodiment thereof, said description being intended to be purely illustrative and not limiting in association with the attached drawings.

DESCRIPTION OF THE PREFERRED EMBODIMENT

Figure 1:
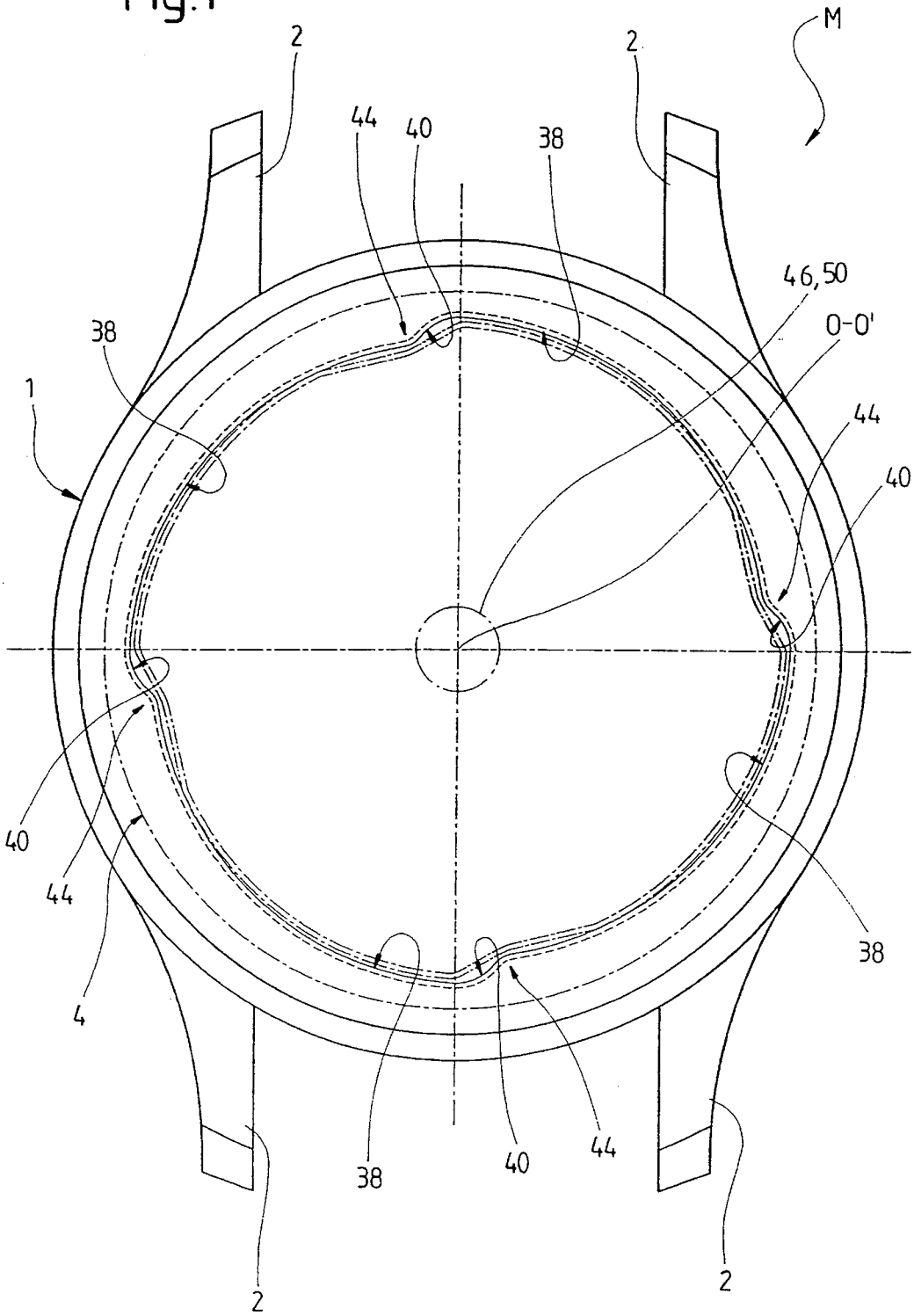
FIG. 1 is a plan view from below of the watch case, the back cover being engaged with the caseband, but not being clamped thereon, and the back cover being shown in broken outline.

In referring to the figures, the sealed watch case designated generally by the generic indication M comprises in particular two elements forming respectively a caseband 1 of generally circular form provided with two pairs of horns 2 and a back cover 4, likewise of circular form.

Caseband 1 comprises a lower face 6 in which is formed an annular groove 8 which receives a packing 10. This latter is intended to be compressed between the surface 12 of a frontal shoulder 14 of back cover 4 and the bottom of groove 8 as formed in the lower face 6.

Shoulder 14 is bounded towards the interior by a lateral wall portion 16 of an annular axial flange 18. The lateral wall portion 16 is axially bounded between two planes P1 and P2 and is in undercut form. Planes P1 and P2 are respectively formed by an upper face 20 of flange 18 and the surface 12 of frontal shoulder 14. In the example shown, the undercut portion of wall 16 is such that it is slightly inclined relative to a closure axis O—O' which, in the example shown, is the geometric axis of the case, that is to say the axis parallel to the axis of rotation of the hands. Preferably, the angle of inclination is on the order of 10°.

The internal face or flange 22 of caseband 1 comprises, in its portion neighbouring the lower face 6, a lateral wall portion 24 forming a groove open towards the exterior in the internal face 22. The lateral wall 24 is also undercut and axially bounded between two planes P3 and P4 which are respectively formed by an annular shoulder 26 and the lower face 6.

The inclination of the wall portion 24 is substantially equal to that of the wall portion 16 of the back cover and the peripheral profile of the wall portion 24 of caseband 1 is complementary to that of the wall portion 16 of back cover 4.

The taper of the undercut walls 16 and 24 respectively for the back cover 4 and caseband 1 is thus, in the example as described, directed in the direction of back cover 4.

In particular, the lateral wall portion 16 of back cover 4 and the lateral wall portion 24 of caseband 1 are conformed so that, in a first angular position relative to the axis O—O' (FIG. 1), the back cover 4 may be separated from the caseband 1 and, in a second angular position (FIG. 2) in which the back cover is rotated through a predetermined release angle W around axis O—O' starting from the first angular position, the back cover 4 is clamped on case-band 1 whilst compressing packing 10. To this effect, flange 18 comprises in its upper portion an edge 28 and in its lower portion an edge 30 which define the height $H_f$ of this flange. Likewise, the groove formed in the internal face 22 comprises in its upper portion an edge 32 and in its lower portion an edge 34 which define the height $H_c$ of this groove. The dimensions of the edge 28 of flange 18 are chosen substantially greater than those of edge 34 of the groove of caseband 1 because of the inclination of faces 16 and 24, and the dimensions of edge 30 of the back cover are substantially identical to those of edge 34 of the caseband. For the rest, the height $H_f$ which corresponds to the distance separating planes P1 and P2 is less than the height $H_c$ which corresponds to the distance separating planes P3 and P4 so that the upper surface of flange 18 does not come into contact with the annular shoulder 26 of the groove of caseband 1 in the second annular position of the back cover such as defined hereinabove.

In referring more specifically to FIGS. 1 to 4, it is seen that the peripheral profile of the lateral wall portion 24 comprises four sections 38 in circular arc form, two sections 38 in successive circular arc form being connected to one another by a reentrant section 40 oriented substantially radially in order to form projections 44. Each section 38 occupies an arc $A_c$ of the rim of the opening of caseband 1 substantially equal to 90° and is centered on a center point $C_c$ shifted relative to the closure axis O—O' and which is merged with the axis of caseband 1 in this specific case. In the example described and illustrated, sections 38 in circular arc form have the same radius $R_c$ so that the centers $C_c$ of each of the sections 38 are arranged on a circle 46 (shown in interrupted lines) the center of which is on the axis O—O'.

Sections 38 in circular arc form are thus off-centered relative to the closure axis O—O' and the distance of their points relative to the axis O—O' varies progressively when sections 38 are traversed over their entire length. In the example described, this distance increases when the sections 38 are traversed in the counter clock-wise sense seen from below.

The peripheral profile of the lateral wall portion 16 of the back cover likewise comprises four sections 48 in circular arc form, each centered on a center point $C_f$ shifted relative to the geometrical axis of the back cover and which is, there again, merged with that of the case. Each section 48 occupies an arc $A_f$ of the rim of the opening of caseband 1 less than 90°, for example about 80°, and exhibits the same radius $R_f$ so that centers $C_f$ of sections 48 are arranged on a circle 50 (shown in broken outline), the center of which is on the axis O—O'. Each section 48 is associated with a section 38 of the caseband and the sections 38, 48 associated with one another have substantially the same radius so that circles 46 and 50 are merged. It will be noted that the value of angle $A_f$ corresponds substantially to the value of angle $A_c$ from which the release angle W is deducted.

Figure 2:
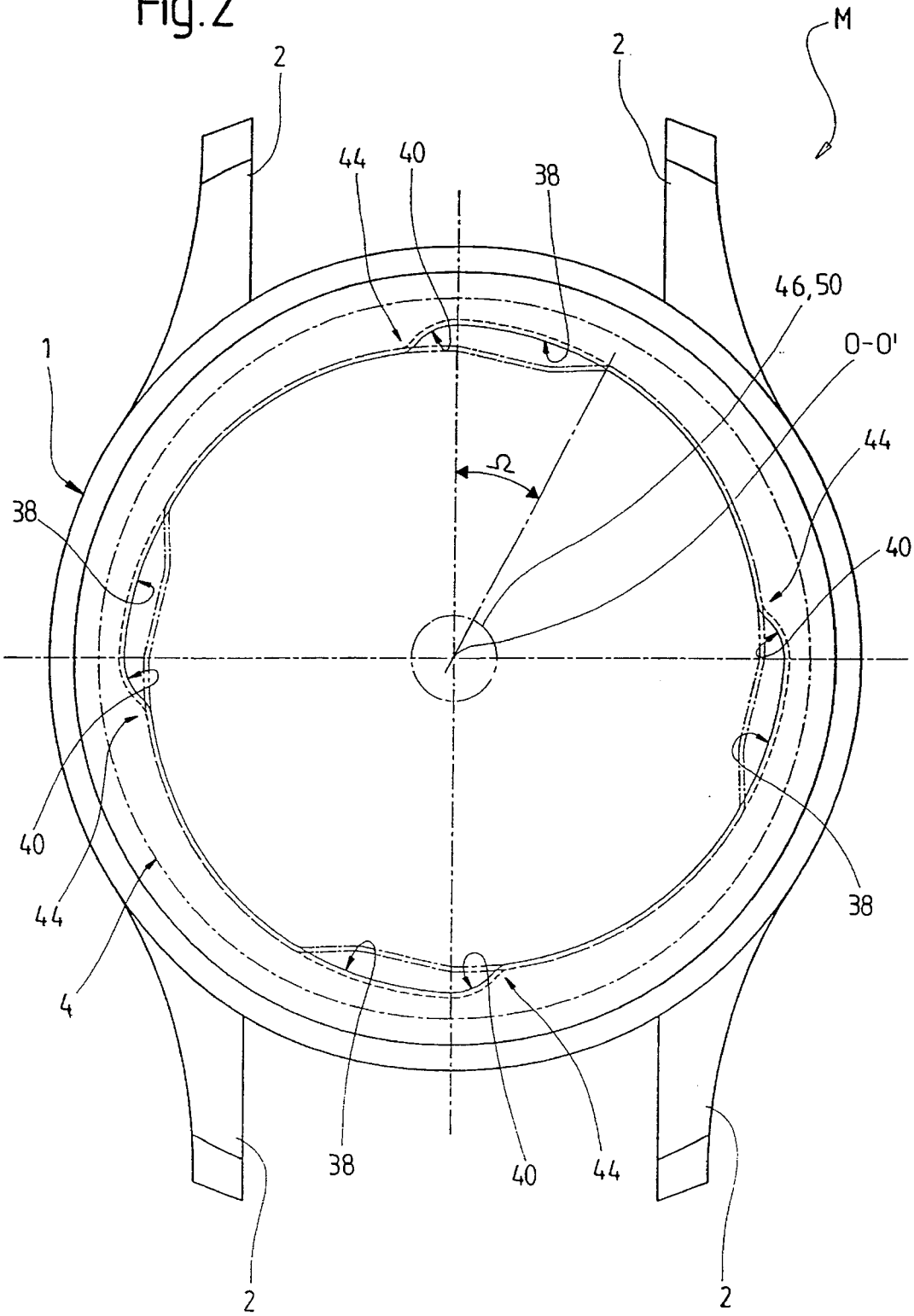
FIG. 2 is a plan view from below of a watch case, the back cover being engaged onto the caseband and clamped thereon, and the back cover being shown in broken outline.
Figure 3:
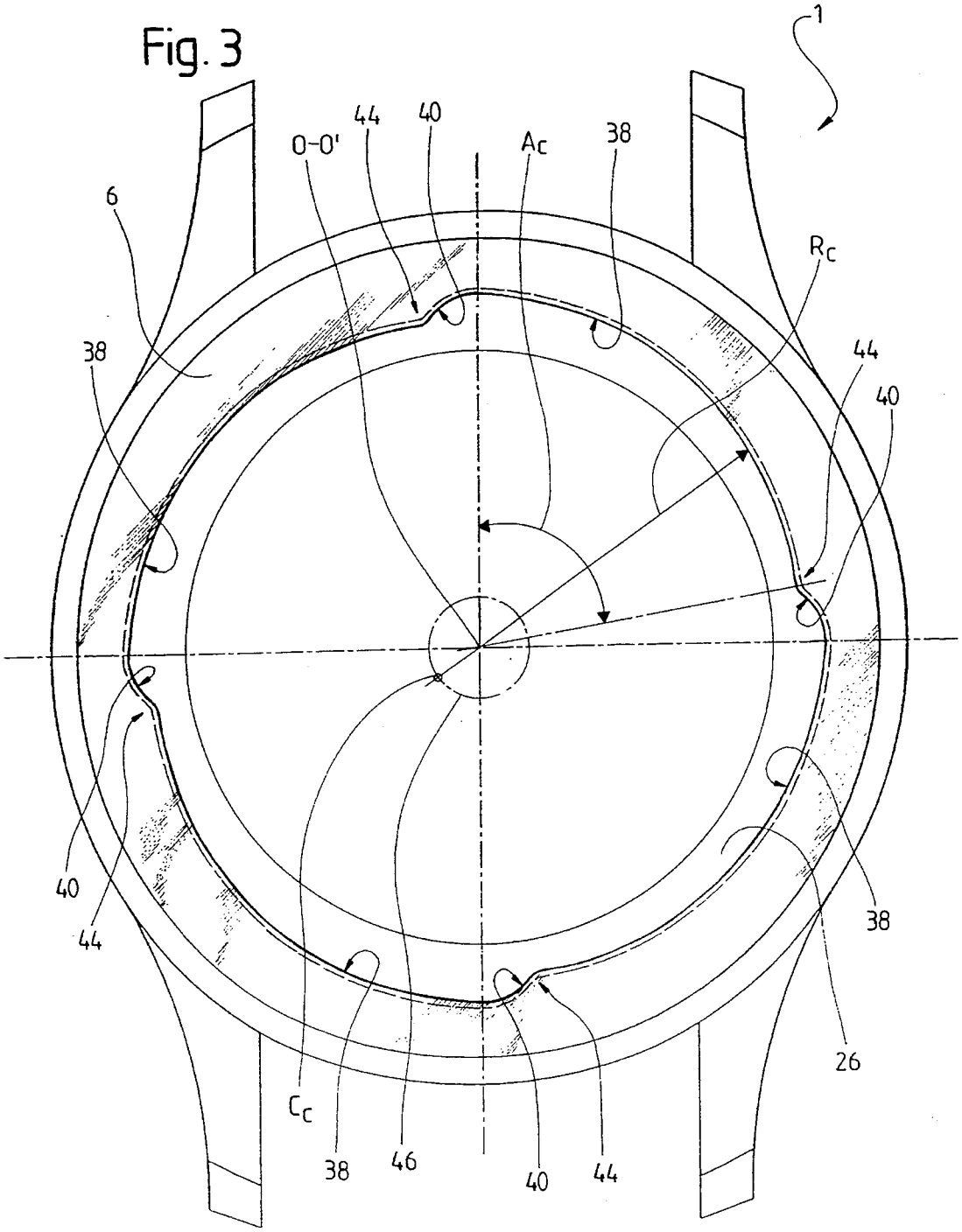
FIGS. 3 and 4 are respectively plan views from below and above of the caseband alone and of the back cover alone, certain dimensions having been exaggerated.
Figure 4:
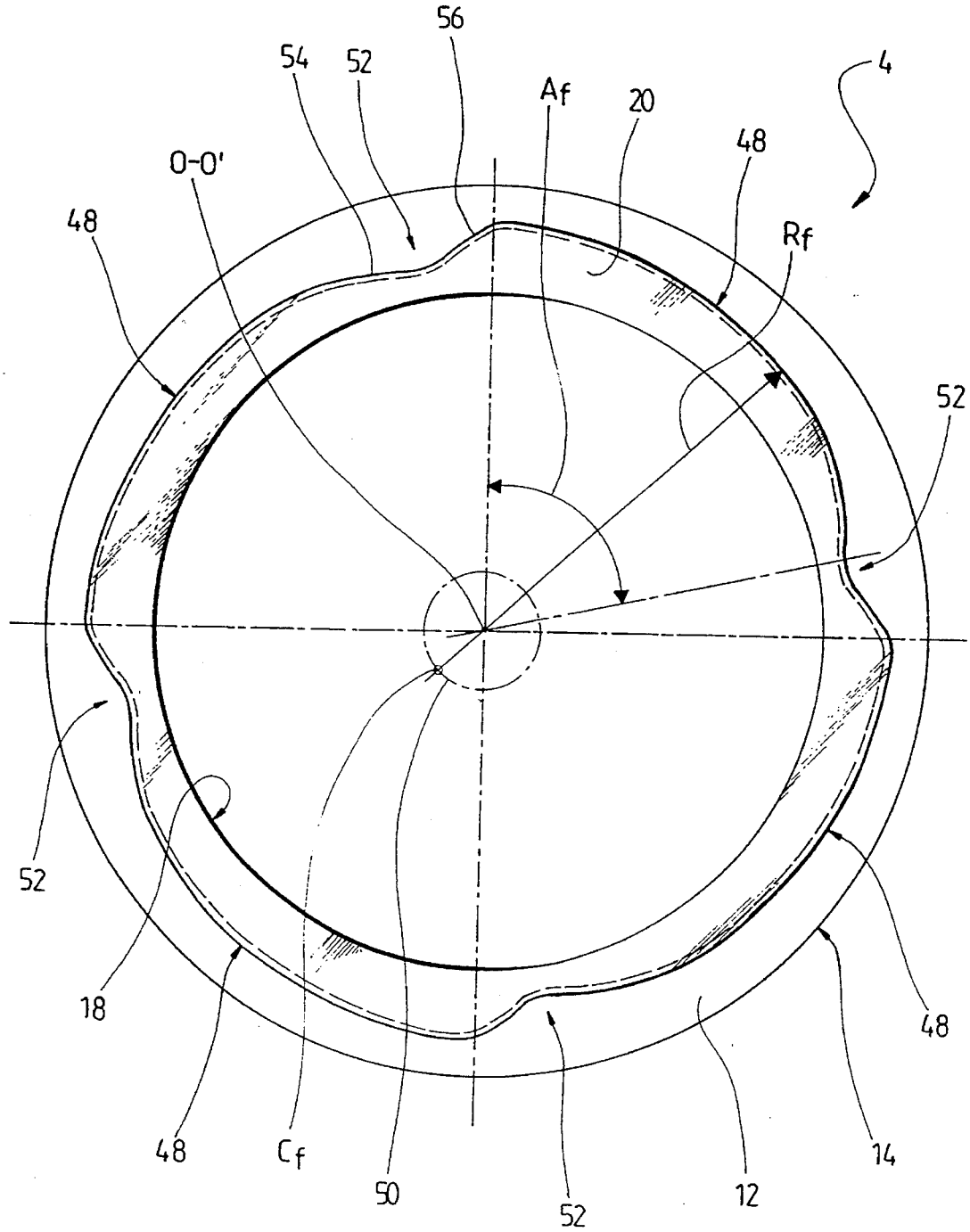
Figure 5:
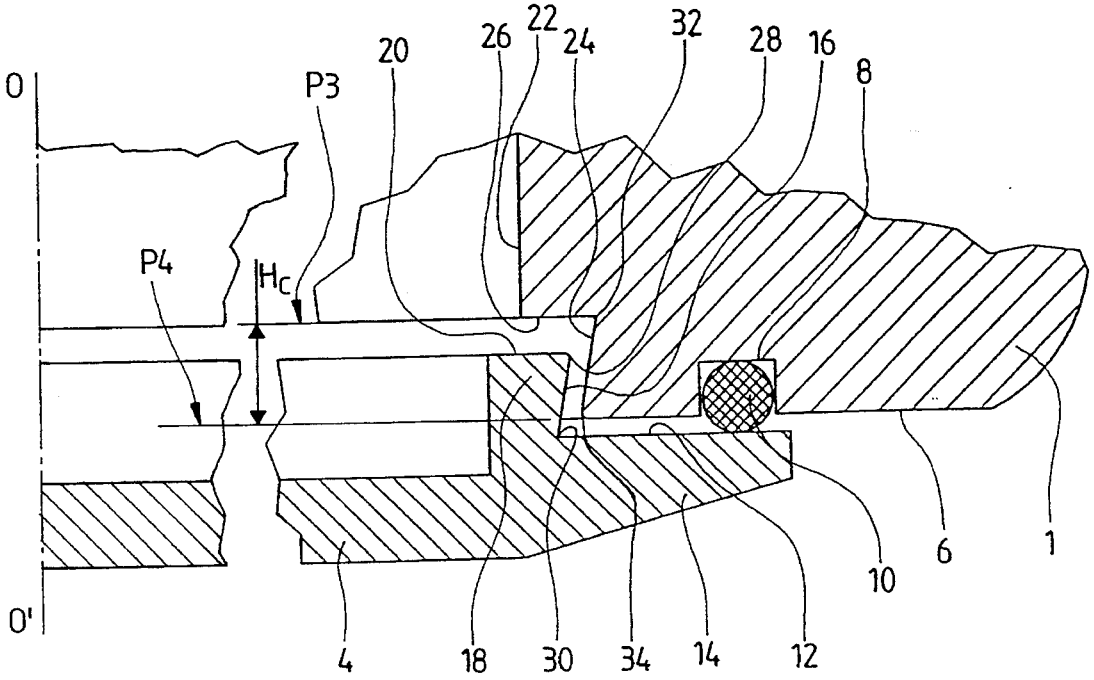
FIG. 5 is a partial cross-section taken along line V—V of FIG. 1.
Figure 6:
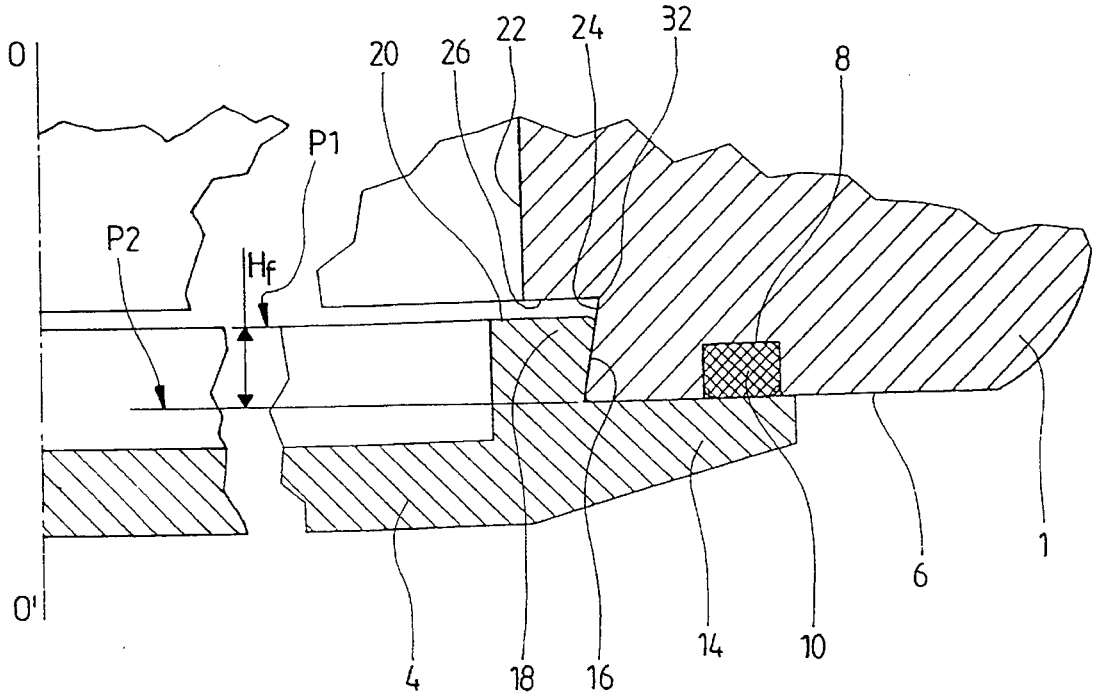
FIG. 6 is a partial cross-section taken along line VI—VI of FIG. 2.

Nevertheless, in a manner different from sections 38 of case-band 1, two successive sections 48 of the back cover are connected to one another by a portion of broken profile defining an opening 52 of depth such that it enables passage of the projections of caseband 1 in the first angular position (FIG. 1). The portion of broken profile comprises a first part 54 which extends, starting from the end of a section 48 in approaching axis O—O' substantially to the normal from the end of the following section 48 in order to rejoin this latter by a second portion 56 extending substantially radially.

Thus, thanks to the profile of the lateral wall portions 16 and 24 respectively of the back cover 4 and caseband 1 of the invention and particularly of the profile of the lateral wall of the back cover having a portion in broken profile such as described hereinabove, flange 18 of back cover 4 can, in the first angular position shown on FIG. 1, be freely engaged in the opening of caseband 1, each section 48 of the back cover being then off-centered relative to the section 38 of the caseband with which it is associated. Thereafter, it is sufficient to rotate the back cover 4 relative to the caseband 1 starting from the first angular position through a predetermined release angle W in order to bring it into the second angular position (FIG. 2) in which each section 48 of the back cover 4 is concentric with the section 38 of the caseband with which it is associated in order to assure clamping of the back cover 4 on the caseband 1. Such rotation through the release angle W in order to pass from the first angular position to the second brings about the progressive penetration of flange 18 of back cover 4 into the caseband, thus causing compression of the packing 10 and brings the lateral wall of each section 48 of the back cover 4 into close contact and over its entire extent with the lateral wall 24 of caseband 1 with which it is associated, thus assuring effective clamping of back cover 4 onto caseband 1.

The release angle W is the minimum angle necessary in order to release the upper edge 28 from the lower edge 34 during rotation of the back cover in the caseband.

In the example described, the release angle W is on the order ot 20°.

Preferably, the release angle W will be the smallest possible in order to increase the contact surface between the walls 16 and 24 and to obtain a better clamping of the back cover onto the caseband. There will thus be obtained compression of the packing over the largest portion of its periphery.

Although in the embodiment of the invention which has just been described the lateral peripheral wall portion 16 of the back cover is external and the lateral peripheral wall portion 24 of the caseband is internal, it is self-evident that according to a variant embodiment the inverse arrangement could be provided. In such latter case, a flange similar to flange 18 is arranged on the caseband 1 in place of the open groove formed in the example described hereinabove by the lateral peripheral wall portion 24 and the shoulder surface 26 and a groove similar to this latter is arranged in the back cover 4 in the place of the flange 18.

It is well understood that still other variant embodiments of the watch case of the invention could be envisaged. For example, it will be possible to provide cases according to the invention in which the lateral wall portions of the back cover and of the caseband exhibit respectively two, three, five or more sections in circular arc form. In such case, the form of the broken profile portion connecting the sections of the back cover will vary as is well understood.

While in the embodiment of the watch case of the invention, all the sections in circular arc form of an element exhibit an identical radius, it can also be provided without departing from the framework of the invention that the sections in circular arc form of one element have different radius and the sections in circular arc form of the other element have corresponding radius.

It will be noted that the relative dimensions of the sections 38 in circular arc form and the sections 48 have been purposely exaggerated in order to facilitate understanding of the invention.

What is claimed is:

1. A sealed watch case comprising two elements respectively forming a caseband and a back cover, and a packing interposed between these two elements, a first of the elements including an axially bounded and undercut lateral peripheral wall portion, the second element likewise exhibiting an axially bounded and undercut lateral peripheral wall portion having a form complementary to the lateral wall portion of said first element, the lateral wall portions of said first and second elements being so conformed that in a first angular position relative to a rotation axis, referred to as the closure axis, the first element may be separated from the second element and that in a second angular position, in which the first element is turned through a predetermined angle around said closure axis starting from the first position, the first element is clamped in the second element whilst compressing the packing, and each of the lateral wall portions of said first and second elements defining a tapered surface inclined relative to said closure axis, the peripheral profile of the lateral wall portion of the first element comprising at least two sections in circular arc form each centered on a point shifted relative to the closure axis, such two sections being connected to one another by a reentrant section in order to form projections, the peripheral profile of the lateral wall portion of the second element comprising at least two sections in circular arc form each centered on a point shifted relative to the closure axis, such two sections being connected to one another by a broken profile portion defining an opening of such depth as to permit, in the first angular position, passage of the projections of the first element into the openings of the second element, each circular arc-formed section of the first element being associated with a circular arc-formed section of the second element, the sections associated with one another having substantially the same radius, and in the first angular position each circular arc-formed section of the first element being off-centered relative to the circular arc-formed section of the second element associated therewith, and in the second angular position each circular arc-formed section of the first element being concentric with the circular arc-formed section of the second element associated therewith so that the tapered surface of the lateral wall of each circular arc-formed section of the second element is in contact over substantially its entire extent with the tapered surface of the lateral wall of the circular arc-formed section of the first element associated therewith.

2. A watch case as set forth in claim 1, wherein said first element is the caseband and said second element is the back cover.

3. A watch case as set forth in claim 1, wherein the lateral wall portion of the back cover is external and the lateral wall portion of the caseband is internal.

4. A watch case as set forth in claim 1, wherein the tapered surfaces of the undercut walls of the first and second elements are directed toward the back cover.

5. A watch case as set forth in claim 1, wherein the peripheral profile of the lateral wall portion of the first element and the peripheral profile of the lateral wall portion of the second element each comprise four sections in circular arc form regularly distributed around the first and second elements.

6. A watch case as set forth in claim 1, wherein the centers of the circular arc-formed sections of the first and second elements are respectively arranged on a circle the center of which is on the closure axis.

7. A watch case as set forth in claim 2, wherein the lateral wall portion of the back cover is external and the lateral wall portion of the caseband is internal.

* * * * *